United States Patent [19]

Widén

[11] Patent Number: 5,067,335

[45] Date of Patent: Nov. 26, 1991

[54] CYLINDER LOCK AND LOCKING TUMBLER

[76] Inventor: Bo Widén, P.O. Box 37, S-644 00 Torshälla, Sweden

[21] Appl. No.: 536,671

[22] PCT Filed: Jan. 20, 1988

[86] PCT No.: PCT/SE88/00015

§ 371 Date: Sep. 12, 1990

§ 102(e) Date: Sep. 12, 1990

[87] PCT Pub. No.: WO89/06733

PCT Pub. Date: Jul. 27, 1989

[51] Int. Cl.[5] ..... E05B 27/10

[52] U.S. Cl. ..... 70/495; 70/419; 70/358

[58] Field of Search ..... 70/493–495, 70/419, 378, 358

[56] References Cited

U.S. PATENT DOCUMENTS

| | | | |
|---|---|---|---|
| 1,947,105 | 5/1934 | Heyer | 70/492 |
| 2,197,952 | 4/1940 | Stone | 70/493 |
| 3,035,433 | 5/1962 | Testa | 70/419 |
| 3,080,744 | 3/1963 | Spain | 70/495 |
| 3,348,392 | 10/1967 | Schreiber | 70/340 |
| 4,478,061 | 10/1984 | Preddey | 70/378 |
| 4,603,565 | 8/1986 | Strassmeir | 70/493 |
| 4,635,455 | 1/1987 | Oliver | 70/419 |
| 4,756,177 | 7/1988 | Widen | 70/419 |
| 4,815,307 | 3/1989 | Widen | 70/493 |

FOREIGN PATENT DOCUMENTS 0103352 3/1984 European Pat. Off. .

*Primary Examiner*—Gary L. Smith
*Assistant Examiner*—Darnell Boucher

[57] ABSTRACT

A rotary type cylinder lock, a lock and key blade combination system and a locking tumbler are disclosed. The lock includes a row of locking tumblers (15*a*, 15*b*, 15*c*) being non-rotatably guided for elevational movement so as to cooperate with a side bar (19) for releasing the lock. The locking tumblers are provided with fingers (18*a*, 18*b*, 18*c*) located in specific positions, so that the free end portions (24*a*, 24*b*, 24*c*) of the fingers, which make contact with a wave-like code pattern of a key blade, form a specific, irregular longitudinal distribution pattern being different from the longitudinal distribution of the tumbler body parts.

10 Claims, 3 Drawing Sheets

CYLINDER LOCK AND LOCKING TUMBLER

BACKGROUND OF THE INVENTION

The invention relates generally to cylinder lock systems of the kind described in the international patent application No. PCT/SE87/00038 (WO87/04749), i.e. systems including a cylinder lock comprising:

a cylinder shell;

a key plug rotationally mounted in said cylinder shell to provide a shear line between said cylinder shell and said key plug;

a longitudinal key slot extending into said key plug parallel to the rotational axis thereof for receiving a key blade having an elongated, generally longitudinally extending wave-like code pattern; and a row of locking tumblers, each tumbler including a body part guided for elevational movement in an associated transverse cavity in said key plug and a finger projecting transversely outwardly from said body part so as to extend into said key slot and engage with said code pattern of a properly shaped key blade being inserted into the key slot; said locking tumblers being blockingly associated with the cylinder shell either directly or indirectly by means of a fence member so that elevational positioning of said locking tumblers with said properly shaped key blade enables clearence of the shear line.

The lock known from the above-mentioned international application has the special feature of a pivotable finger on each locking tumbler, so that the finger causes the respective tumbler to be specifically rotated when a properly shaped key is being inserted into the lock. Thus, a very high number of code combinations and a good resistance against picking are obtained. However, this feature makes the lock and the key blade relatively complicated and expensive.

SUMMARY OF THE INVENTION

The object of the present invention is to provide a cylinder lock and key system which is somewhat easier and less expensive to manufacture while retaining the most important advantages of the previously known system.

This object is achieved in that the cylinder lock is provided with non-rotatable tumblers and associated fingers.

The inventive concept also includes a cylinder lock and key blade combination system with a master key, and a locking tumbler for use with a cylinder lock.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will be described more fully below with reference to the appended drawings which are given by way of illustration only, and thus are not limitative of the present invention, and wherein.

DETAILED DESCRIPTION OF THE PREFERRED EMBODIMENTS

Figure 3:
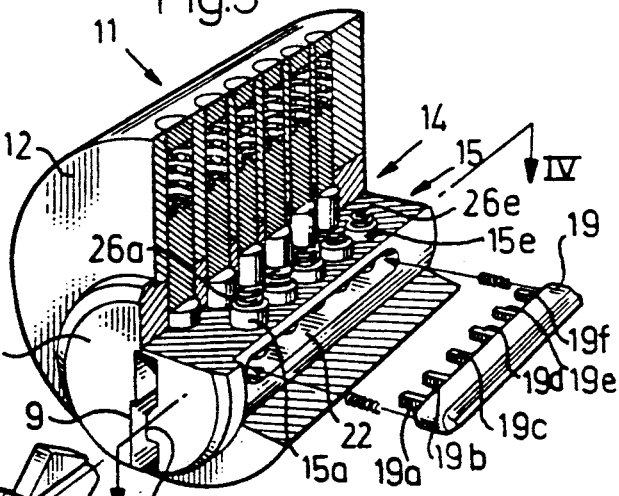
FIG. 3 illustrates a lock according to the invention to be used in combination with the key blade of FIG. 1, a part of the lock being broken away to show the inside thereof.
Figure 1:
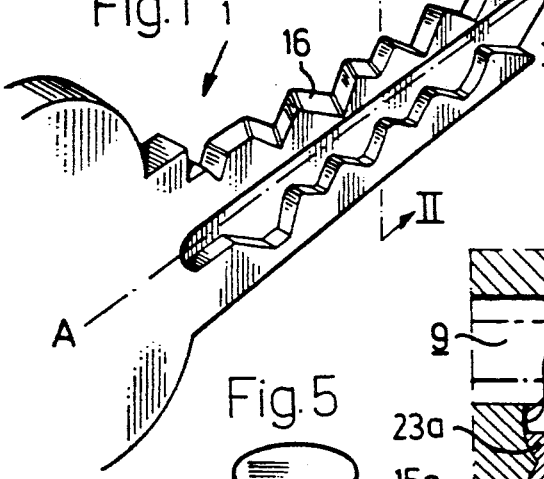
FIG. 1 illustrates a key blade in a perspective view.

The key blade 1 shown in FIG. 1 has a longitudinal axis A of insertion and insertable into the lock shown in FIG. 3.

Figure 2A:
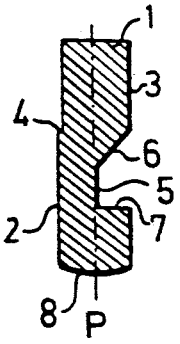
FIG. 2*a* is a transverse section along line II—II in FIG. 1.

As shown in FIG. 2*a*, the key blade generally flat with substantially planar side surfaces 2 and 3. The side surface 2 to the left in FIG. 2*a* has a minor step 4, and the side surface to the right in FIG. 2*a* has a longitudinal groove 5 with an upper side wall 6 inclined so as to face away from the blade 1 and a lower side wall 7 oriented substantially at a right angle to the central plane P of the blade. Furthermore, the lower edge surface 8 is slightly curved.

Figure 2B:
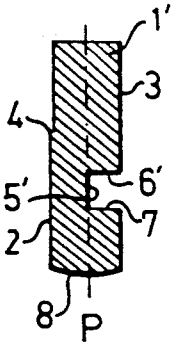
FIG. 2*b* is a similar section through a slightly modified key blade.

In the modified key blade 1' shown in FIG. 2*b*, the longitudinal groove 5' has two mutually parallel side walls 6' and 7 oriented at right anglesto the central plane P.

It will be apparent from FIGS. 1, 2*a* and 3 that the key blade 1 has a cross-sectional shape fitting into the key slot 9 of the lock. With a slight modification of the ridge 10 at the right hand side wall of the key slot 9, the modified key blade 1' of FIG. 2*b* will also fit into the lock.

The lock 11 is of the rotary type and comprises a cylinder shell 12 and a key plug 13 rotationally mounted in the shell 12 to provide a shear line between the shell 12 and the plug 13 in parallel to the rotational axis thereof for receiving the key blade 1.

The lock 11 includes two rows 14, 15 of locking tumblers or pins located in two mutually parallel planes. A first row 14 of six locking pins is centrally located substantially in the central plane of the key slot 9 so as to cooperate with the upper edge portion 16 of the key blade 1, as described in the above-mentioned international application No. PCT/SE87/00038. A second row 15 of five locking tumblers or pins 15*a*–15*e* is laterally offset (to the right in FIG. 3). In the illustrated embodiment, each locking pin 15*a*–15*e* is totally confined with the key plug 13 in a corresponding, cylindrical cavity or bore 17*a*–17*e*, respectively (compare also FIG. 4).

According to the present invention, the locking tumblers 15a–15e in the second row are non-rotatably guided in the respective bores 17a–17e and are each provided with a finger 18a–18e, which projects transversely outwardly in a specific position into the key slot 9. Thus, the locking tumblers 15a–15e are only movable elevationally, and upon a specific elevational positioning of each such locking tumbler by means of a properly shaped key blade 1, a common fence member or side bar 19 will be allowed to engage into recesses 20a–20e formed in the cylindrical surfaces of the body parts 21a–21e of the tumblers and to be displaced transversely into its inward, seated position in the slot 22 of the key plug 13, thus clearing the shear line and releasing the lock. As an alternative, the locking tumblers may engage directly with the cylinder shell (e.g. in the same manner as the locking tumblers of the first row 14). Each locking tumbler 15a–15e includes a substantially cylindrical body part 21a–21e and a finger 18a–18e with a relatively wide base portion 23a–23e and a relatively narrow, substantially cylindrical finger end portion 24a–24e, as illustrated by the three different tumblers 15a, 15b, 15c shown in FIG. 6b, FIG. 6c and FIGS. 6a, 6d, 6e, respectively.

Figure 6A:
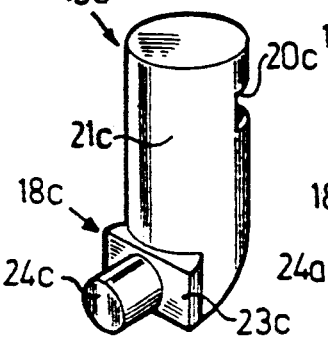
FIGS. 6*a*–6*c* show, likewise in perspective views, three different locking tumblers made from a blank as shown in FIG. 5.
Figure 6B:
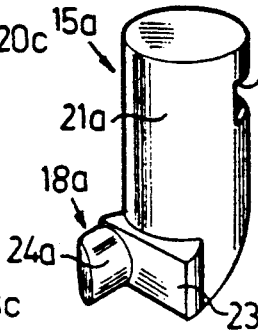
Figure 6C:
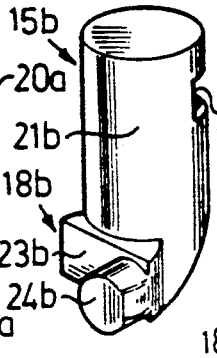
Figure 6D:
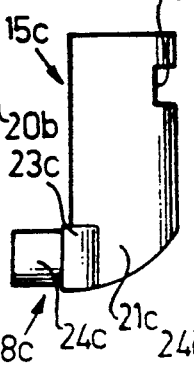
FIGS. 6*d* and 6*e* show a locking tumbler in side and front views, respectively.
Figure 6E:
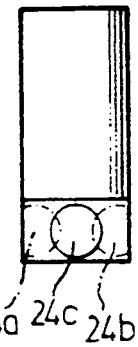

The three different tumblers are all made from a similar tumbler blank 15' having a substantially cylindrical body part 21' and a likewise cylindrical or disc-like finger blank part 18', from which the material is cut out so as to form the desired finger end portion located centrally (24c, FIG. 6a), to the left as seen in FIG. 6b (24a) or to the right as seen in FIG. 6c (24b). Compare also FIG. 6e.

Figure 4:
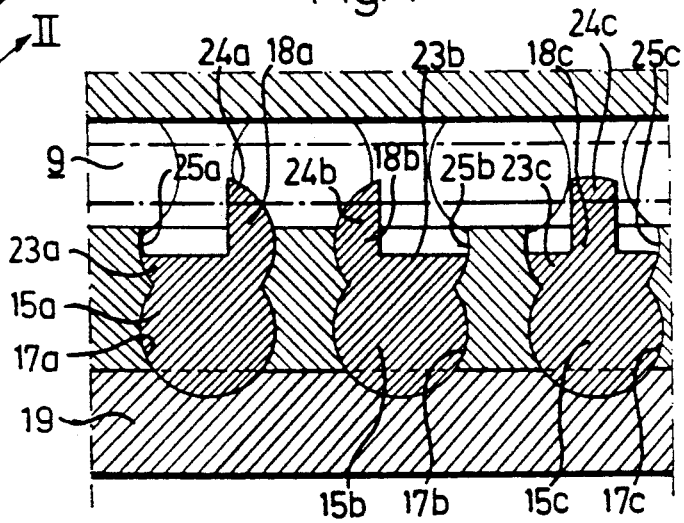
FIG. 4 shows, in a larger scale, a partial section through the key plug of the lock of FIG. 3.
Figure 5:
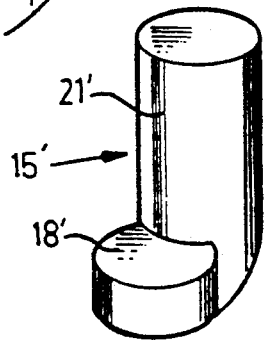
FIG. 5 shows a locking tumbler blank in perspective view.

As appears from FIG. 4, the part-cylindrical base portion 23a, 23b, 23c, etc. of each finger is guided for elevational movement in a corresponding part-cylindrical bore 25a, 25b, 25c, etc. located adjacent and parallel to the respective bore 17a, 17b, 17c, etc. so as to be open transversely to the key slot 9 into which the respective finger end portion 24a, 24b, 24c, etc. extends for making contact with an inserted key blade.

In a given lock, the finger end portions 24a, 24b, 24c, etc. will be distributed in a specific, irregular pattern along the key slot 9, which pattern is generally different from the (normally uniform) longitudinal distribution of the finger body parts 21a, 21b, 21c, etc. in the longitudinal direction (in parallel to the key slot 9 and the axis A of insertion of the key blade).

Thus, in spite of the fact that the locking tumblers in the row 15 are non-rotatably guided by means of the relatively wide base portions 23a, 23b, 23c, etc., it is possible to obtain a specific longitudinal code pattern with $3^5=243$ possible combinations. In case the recesses 20a, 20b, 20c are also distributed in three different elevational positions, the total number of code combinations will be $243\times243=59059$.

The finger end portions 24a, 24b, 24c etc. make contact with the lower side wall 7 of the groove 5 provided in the side surface 3 of the key blade. As appears from FIGS. 1 and 2a, in the side wall 7, there is formed an elongated, longitudinally extending wave-like code pattern surface, against which the finger end portions are urged downwards by means of compressive springs 26a–26e (see FIG. 3) acting on the upper portion of the respective body part 21a, 21b, 21c, etc. Alternatively, the opposite side wall 6' may be formed, e.g. by means of a cutter pin, with an identical configuration as the lower side wall code pattern surface 7, in which case the respective finger end portion 24a, 24b, 24c, etc. will be held with a slight play between the opposite side wall surfaces 6', 7 (compare FIG. 2b), and the compressive springs 26a–26e can be left out. The tumblers 15a–15e will then be positively guided by the wave-like key groove so as to reciprocate elevationally in response to the wave-like groove pattern when the key blade 1' is being inserted into the key lock.

It should be noted that the one-sided or two-sided guiding surface (7 or 6', 7, respectively) or the key groove 5, 5' is rather easy to make, e.g. by means of a cutter pin in one step, since the guiding surface can preferably be perpendicular to the side surface 3 (and the groove bottom surface) of the key blade along the whole length thereof. Furthermore, the rest position of the respective finger end portion (in the fully inserted position of the key blade) does not have to be located in a concavity location (as was necessary in the lock and key system described in the above-mentioned international application) but may be situated at any well-defined, preferably substantially horizontal portion of the code pattern surface.

Figure 7A:
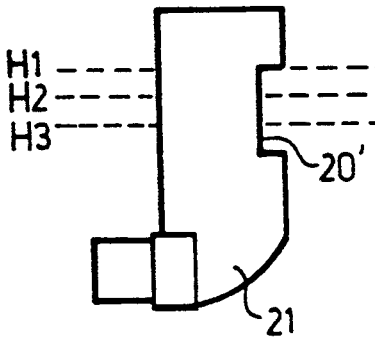
FIGS. 7*a*–7*c* show schematically three different locking tumblers in side views.
Figure 7B:
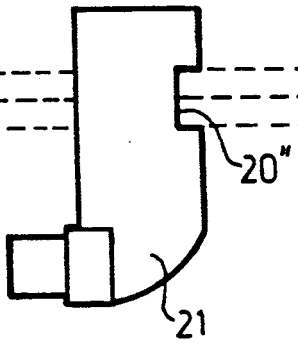
Figure 7C:
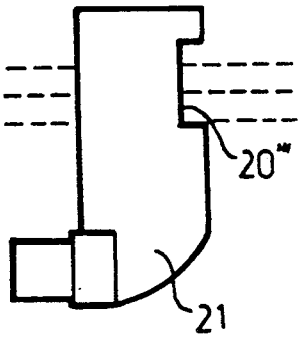

In FIGS. 7a, 7b, 7c, there is illustrated how the recesses 20', 20'' and 20''' may be distributed elevationally in the body part 21 of the respective tumbler, wherein the recess 20' (FIG. 7a) can accomodate the side bar 19 in either one of two elevational positions (H2, H3), as can the recess 20''' (FIG. 7c, H1, H2), whereas the recess 20'' (FIG. 7b) requires the side bar to be in position H2. As previously known per se, such elevationally distributed recesses of different height can be used to establish a master key system (another possibility will be explained below with reference to FIGS. 9a, 9b, 9c). Of course, the displacement of the side bar 19 into its seated position within the recess 22, in the embodiment shown in FIG. 3 with two rows 14, 15 of tumblers, also requires the lugs 19a–19f to be accommodated in corresponding recesses (not shown) in the locking pins in the first row 14.

Figure 8A:
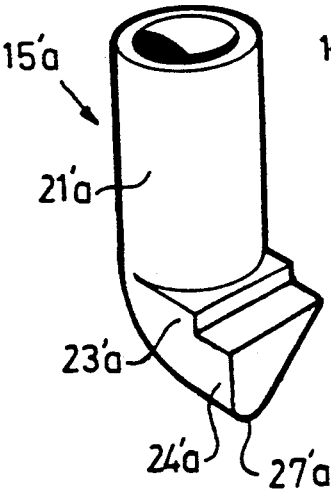
FIGS. 8*a*–8*c* show, in perspective views, three different locking tumblers of a modified kind.
Figure 8B:
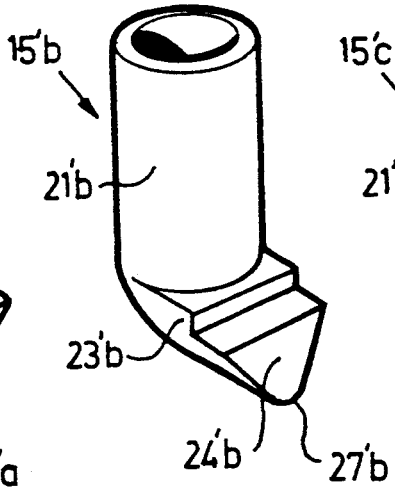
Figure 8C:
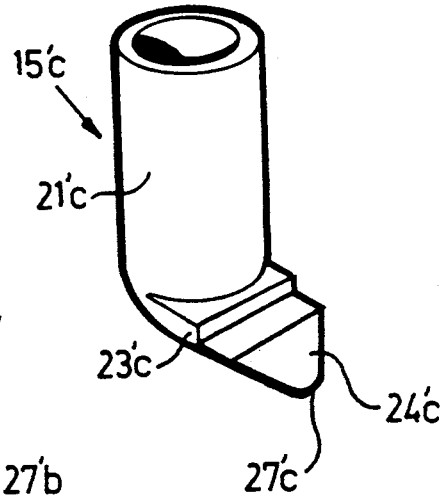

An essential feature of the present invention is that the free end portions of the locking tumbler fingers are located in specific, predetermined positions. In principle, this can be achieved with finger end portions each extending at a specific angle from the central axis of the tumbler body part. Another possible embodiment is illustrated in FIGS. 8a, 8b and 8c wherein the tumblers 15'a, 15'b and 15'c have fingers including a relatively wide base portion 23'a, 23'b, 23'c, which is guided in a corresponding recess adjacent to the bore housing the body part 21'a, 21'b, 21'c of the tumbler and thus prevents rotation of the tumbler, and a relatively narrow finger end portion 24'a, 24'b, 24'c, each having a substantially triangular cross section with one rounded corner portion 27'a, 27'b, 27'c constituting a specifically located (to the left, centrally, or to the right as shown) bearing surface adapted to make contact with the code pattern of the key blade.

Figures 9A, 9B, 9C:
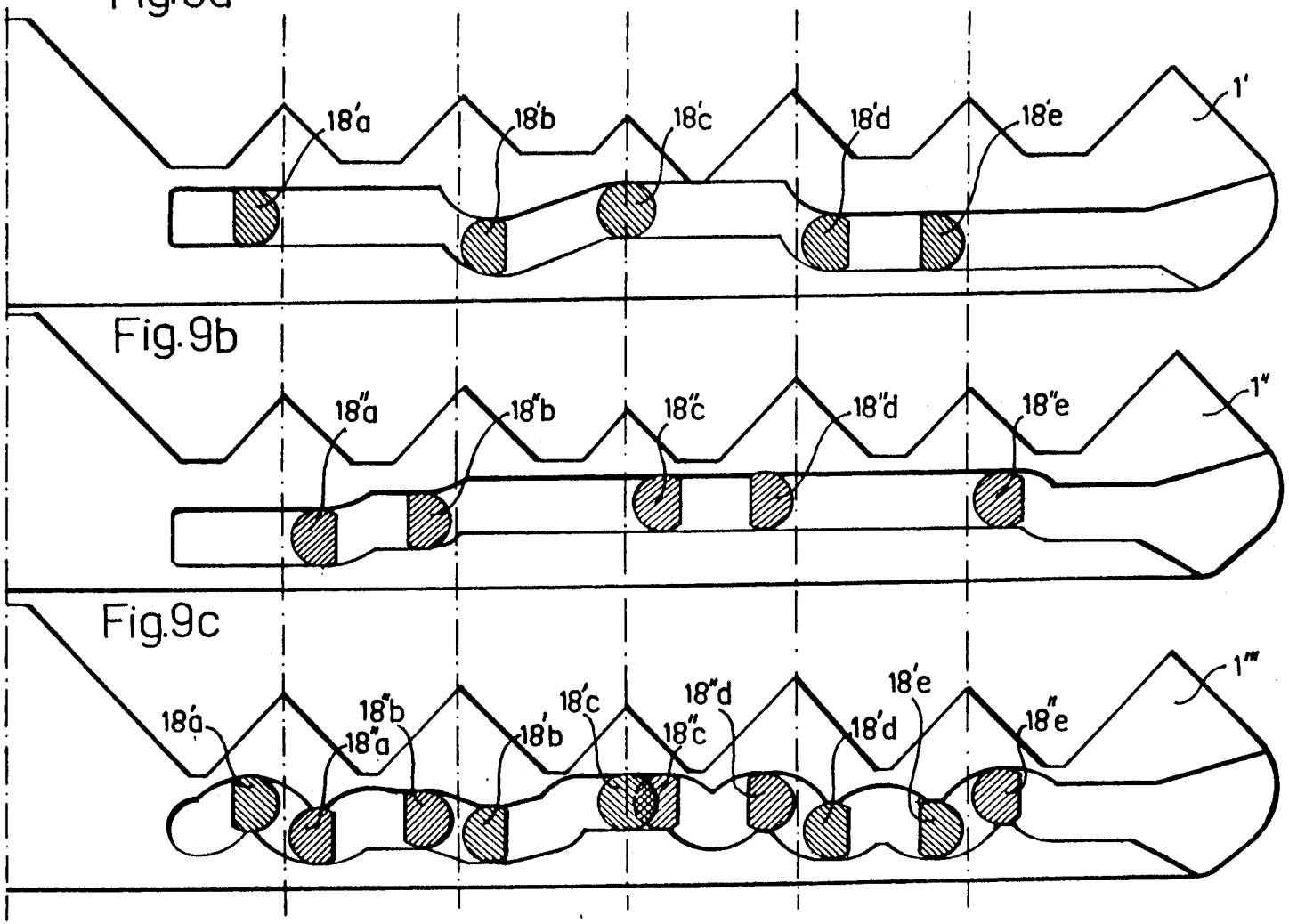
FIGS. 9*a*–9*c* show, in side views and in a larger scale, three different key blades cooperating with locking tumblers as shown in FIGS. 6*a*–6*c*, including a master key blade (FIG. 9*c*).

The predetermined, irregular longitudinal distribution pattern of the finger end portions will also provide an advantageous possibility of establishing a master key system, as illustrated in FIGS. 9a, 9b, 9c. The relatively simple groove code patterns of the key blades 1' and 1'' are specifically configurated to correspond to one specific lock only (having the fingers 18'a–18'e and 18''a–18''e, respectively), whereas the more complex groove code pattern of the master key blade 1''' (FIG. 9c) includes all the critical code pattern portions of the key blades 1' and 1'' so as to match the predetermined finger positions of both locks. It will be understood that this principle can be applied in combination with differently located recesses in the body portions of the tumblers to provide a sophisticated master key system.

Naturally, the inventive concept may be materialized in many ways within the scope of the claims. As to the expression "irregular longitudinal distribution pattern" it should be noted that "irregular" denotes the normal case with more or less randomly positioned finger end portions.

However, in a few possible combinations, all of the finger end portions may be positioned alike, e.g. to the left, centrally, or to the right.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A cylinder lock comprising:

a cylinder shell;

a key plug rotationally mounted in said cylinder shell to provide a shear line between the cylinder shell and the key plug;

a longitudinal key slot extending into said key plug generally parallel to a rotational axis thereof for receiving a key blade, the key blade having an elongated generally longitudinally extending wave-like code pattern;

a row of lock tumblers, each of said tumblers having a body part and a finger, each of the body parts of the tumblers being non-rotatably guided for elevational movement only in an associated transverse cavity in said key plug, each of the fingers of the tumblers projecting transversely outwardly from said body part to extend into said key slot and engage the code pattern of a properly shaped key blade inserted into the key slot, said fingers being located in such predetermined positions that a free end portion of each finger forms a specific, irregular longitudinal distribution pattern different from a longitudinal distribution of the tumbler body parts; and a fence member for blockingly associating the locking tumblers with the cylinder shell so that elevational positioning of said locking tumblers with said properly shaped key blade enables clearance of the shear line.

2. The cylinder lock as defined in claim 1, wherein each finger is positioned in a specific angular position relative to the associated body part.

3. The cylinder lock as defined in claim 1, wherein each of said fingers has a longitudinal axis, the axes of the fingers being generally parallel to one another and being offset a specific distance relative to a central axis of the associated body part.

4. The cylinder lock as defined in claim 3, wherein all fingers have a relatively wide base portion which fits into an associated recess adjacent to the transverse cavity in which the associated body part is positioned so that the tumblers are non-rotatably guided, the free end portions of each of the fingers having a specifically positioned, relatively narrow end with at least one bearing surface for contacting the code pattern of the key blade.

5. The cylinder lock as defined in claim 4, wherein the free end portions have a substantially circular cross-section.

6. The cylinder lock as defined in claim 5, wherein the free end portions have a substantially triangular cross section with a rounded corner edge forming said bearing surface.

7. The cylinder lock as defined in claim 1, 2, 3, 4, 5, or 6, wherein a cylinder lock and key blade combination system is provided by a plurality of specific locks and key blades, each of the key blades having specific elongated, generally longitudinally extending wave-like code patterns corresponding to the specific cylinder locks and wherein the system further includes at least one master key blade, the master key blade having a code pattern corresponding to at least two different specific key blade code patterns of the plurality of key blades.

8. The cylinder lock as defined in claims 1, 2 or 3, wherein said fingers have a relatively wide base portion which prevents rotational movement of the lock tumblers and the free end portions of the fingers have a relatively narrow end with at least one bearing surface for contacting the code pattern of the key blade.

9. The cylinder lock as defined in claim 1, wherein the longitudinal distribution of the tumbler body parts along the row of lock tumblers is generally uniform and wherein the spacing between adjacent free end portions of the fingers varies along the row of lock tumblers.

10. The cylinder lock as defined in claim 1, wherein each of the body parts of the tumblers has a central axis along which said body part is guided for elevational movement and wherein each of the free end portions of the fingers has a longitudinal axis generally perpendicular to the central axis of the body part associated therewith, the axes of the free end portions of the fingers in the row of tumblers being randomly positioned relative to the central axis of the associated body part to form the specific, irregular longitudinal distribution pattern for the free end portions of the fingers along the row of lock tumblers.

* * * * *